US008721960B2

(12) United States Patent
Hatano et al.

(10) Patent No.: US 8,721,960 B2
(45) **Date of Patent: *May 13, 2014**

(54) HIGH-PURITY FERRITIC STAINLESS STEELS EXCELLENT IN CORROSION RESISTANCE AND METHOD OF PRODUCTION OF SAME

(75) Inventors: Masaharu Hatano, Tokyo (JP); Akihiko Takahashi, Tokyo (JP); Eiichiro Ishimaru, Tokyo (JP); Shigenori Takahata, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/998,816

(22) PCT Filed: Dec. 7, 2009

(86) PCT No.: PCT/JP2009/070788

§ 371 (c)(1),
(2), (4) Date: Jun. 2, 2011

(87) PCT Pub. No.: WO2010/067878

PCT Pub. Date: Jun. 17, 2010

(65) Prior Publication Data

US 2011/0265920 A1 Nov. 3, 2011

(30) Foreign Application Priority Data

Dec. 9, 2008 (JP) ..... 2008-313700
Dec. 4, 2009 (JP) ..... 2009-276786

(51) Int. Cl.

| | |
|---|---|
| ***C22C 38/28*** | (2006.01) |
| ***C22C 38/00*** | (2006.01) |
| ***C22C 33/00*** | (2006.01) |
| ***C22C 38/18*** | (2006.01) |
| ***C21D 8/00*** | (2006.01) |

(52) U.S. Cl.
USPC ..... 420/68; 420/70; 420/71; 148/325; 148/651

(58) Field of Classification Search
USPC ..... 148/325, 608, 610, 651, 652; 420/34, 420/68, 70, 71
See application file for complete search history.

(56) References Cited

U.S. PATENT DOCUMENTS

| | | | | |
|---|---|---|---|---|
| 6,423,159 | B1 | 7/2002 | Liesert et al. | |
| 2004/0055674 | A1 * | 3/2004 | Yazawa et al. | 148/610 |
| 2010/0150770 | A1 | 6/2010 | Hiraide et al. | |

FOREIGN PATENT DOCUMENTS

| | | |
|---|---|---|
| EP | 1 571 227 | 9/2005 |
| JP | 06-172935 | 6/1994 |
| JP | 07-034205 | 2/1995 |
| JP | 11-12704 | 1/1999 |
| JP | 11-92872 | 4/1999 |
| JP | 2000-169943 | 6/2000 |
| JP | 2001-262234 | 9/2001 |
| JP | 2001-288543 | 10/2001 |
| JP | 2001-288544 | 10/2001 |
| JP | 2001-355048 | 12/2001 |
| JP | 2005-220429 | 8/2005 |
| JP | 2008-001945 | 1/2008 |
| JP | 2008-190003 | 8/2008 |
| TW | 2009-48988 | 12/2009 |
| WO | WO 2007/129703 | 11/2007 |
| WO | 2009/096244 | 8/2009 |

OTHER PUBLICATIONS

Masui et al., English machine translation of JP 2001-262234, Sep. 26, 2001, whole document.*

Hatano et al., English machine translation of JP 2008-001945, Jan. 10, 2008, whole document.*

Davis et al., "Fabrication of Wrought Stainless Steels-Heat Treating", Metals Handbook Desk Edition, 2002, ASM International, p. 1-2.*

Hudson, R.M., "Pickling and Descaling-Continuous Pickling", ASM Handbook, 1994, ASM International, vol. 5, p. 1-4.*

Douthett, J., "Heat Treating of Stainless Steels-Ferritic Stainless Steels", ASM Handbook, 1991, ASM International, vol. 4, p. 1-3.*

International Search Report dated Mar. 23, 2010 issued in corresponding PCT Application PCT/JP2009/070788.

Extended European Search Report dated Oct. 16, 2013 issued in corresponding EP Application No. EP 09 83 1981.

* cited by examiner

*Primary Examiner* — Roy King
*Assistant Examiner* — Caitlin Kiechle
(74) *Attorney, Agent, or Firm* — Kenyon & Kenyon LLP

(57) ABSTRACT

The present invention provides a ferritic stainless steel comprised of, by mass %, C: 0.001 to 0.02%, Si: 0.01 to 0.6%, Mn: 0.01 to 0.6%, P: 0.005 to 0.04%, S: 0.0001 to 0.01%, Cr: 13 to 22%, N: 0.001 to 0.02%, Al: 0.005 to 0.05%, Sn: 0.001 to 1%, and a balance of Fe and unavoidable impurities, which steel satisfies the following formulae: $0<I(Fe)/I(Cr)<5$ and $0<I(O)/I(Sn)<3$, where I(Fe), I(Cr), I(Sn), and I(O) are the X-ray intensities of the Fe oxides, Cr oxides, Sn oxides, and the sum of X-ray intensities other detected oxides at the steel surface measured by an X-ray photoelectron spectrometer. The present invention also provides a method of producing the ferritic stainless steel.

7 Claims, 1 Drawing Sheet

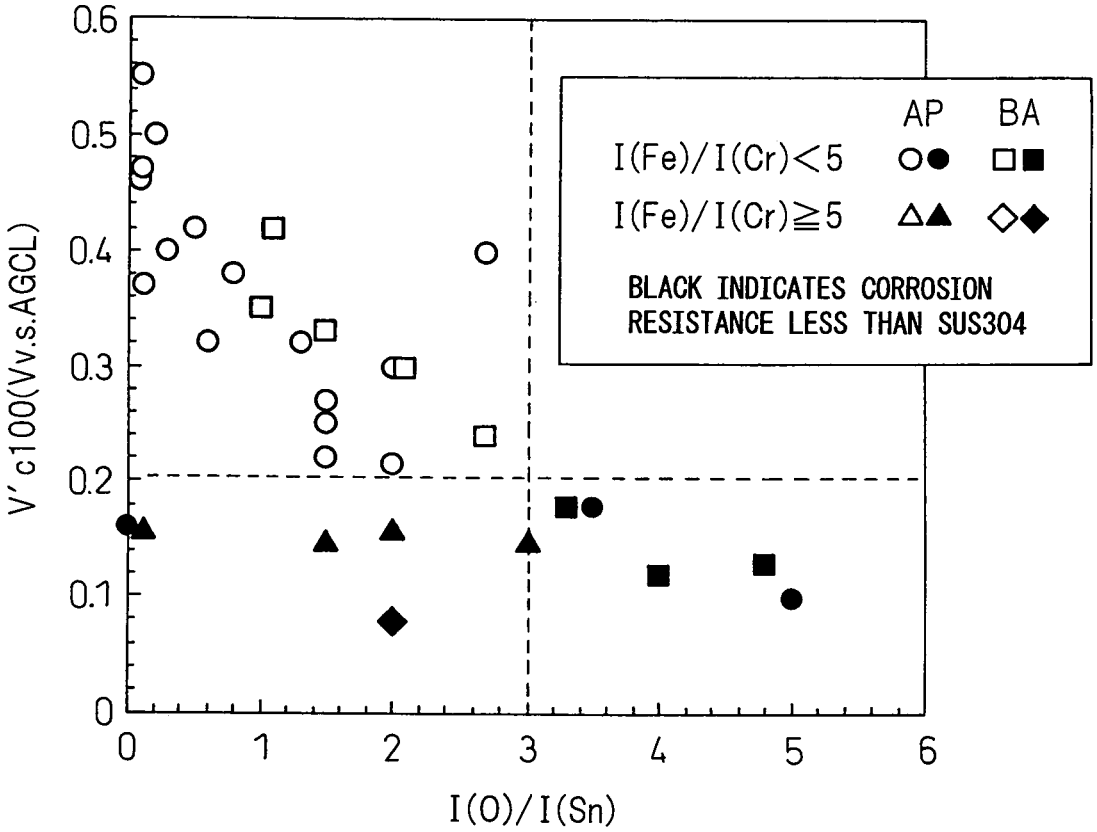
0.6
0.5
0.4
0.3
0.2
0.1
0
V'c100(Vv.s.AGCL)
0
1
2
3
4
5
6
I(O)/I(Sn)
AP
BA
I(Fe)/I(Cr)<5
I(Fe)/I(Cr)≧5
BLACK INDICATES CORROSION RESISTANCE LESS THAN SUS304

HIGH-PURITY FERRITIC STAINLESS STEELS EXCELLENT IN CORROSION RESISTANCE AND METHOD OF PRODUCTION OF SAME

This application is a national stage application of International Application No. PCT/JP2009/070788, filed 7 Dec. 2009, which claims priority to Japanese Application Nos. 2008-313700, filed 9 Dec. 2008; and 2009-276786, filed 4 Dec. 2009, each of which is incorporated by reference in its entirety.

TECHNICAL FIELD

The present invention relates to an alloy-saving type of high purity ferritic stainless steel excellent in corrosion resistance and a method of production of the same.

BACKGROUND ART

Ferritic stainless steel is used in broad fields such as kitchen equipment, home electrical appliances, electronic equipment, etc. However, it is inferior in formability compared with austenitic stainless steel, so the applications are sometimes limited. In recent years, improvements in refining techniques have enabled extreme reduction of carbon and nitrogen, reduction of Si, and also reduction of P, S, and other impurity elements. Ferritic stainless steel improved in formability by addition of Ti or other stabilizing elements (below, "high purity ferritic stainless steel") is being used for an increasingly broader range of forming applications. This is because ferritic stainless steel is better in economy compared with austenitic stainless steel containing large amounts of Ni—which has been skyrocketing in price in recent years.

High purity ferritic stainless steel, as will be understood from SUS430LX standardized by the JIS, often has a lower amount of Cr compared with the typical austenitic stainless steel SUS304 (18Cr-8Ni) and has problems in corrosion resistance. For stainless steel sinks or other kitchen equipment or home electrical appliances where aesthetic appearance is demanded, deterioration of the surface properties due to pitting, corrosioning, or another corrosion is often a problem.

To improve the above corrosion resistance, there is the method of alloying Cr, Mo, etc. and the method of using bright annealing to modify the coating formed on the steel surface. The former invites a rise in cost due to the alloying and becomes a factor inhibiting formability, so is not preferable. The latter is a method effective from the viewpoints of suppressing the rise in the cost of materials and the drop in formability. Various inventions have been disclosed regarding the modification of coatings utilizing bright annealing.

From the latter viewpoint, PLT 1 discloses bright annealed finished ferritic stainless steel sheet excellent in corrosion resistance and formability which has a ratio of concentration of Cr/Fe in the coating of more than 0.5 and includes $TiO_2$ in the coating and a method of production of the same. However, in steel utilizing bright annealing for modifying the coating, when forming and subsequent polishing/grinding causes new surfaces to be exposed, problems remain in securing corrosion resistance at the new surfaces. PLT 1 does not describe measures against these problems.

As means for solving the above problems, the method of utilizing trace amounts of elements to improve the corrosion resistance may be considered. PLT 2 and PLT 3 disclose ferritic stainless steel in which P is deliberately added to improve the weather resistance, corrosion resistance, and crevice corrosion resistance. PLT 2 discloses high Cr and P ferritic stainless steel containing Cr: over 20% to 40% and P: over 0.06% to 0.2%. PLT 3 discloses P ferritic stainless steel containing Cr: 11% to less than 20% and P: over 0.04% to 0.2%. However, P becomes a factor inhibiting manufacturability, formability, and weldability.

PLT 4 discloses ferritic stainless steel excellent in high temperature strength which includes trace elements of Sn and Sb and a method of production of the same. The majority of the steels shown in the examples of PLT 4 is low Cr steel of Cr: 10 to 12%. With high Cr steel of over Cr: 12%, to secure high temperature strength, V, Mo, etc. are added together. As effects of Sn and Sb, improvement of the high temperature strength is mentioned, but there is no description relating to the corrosion resistance.

PLT 5 describes a method of production of ferritic stainless steel sheet for automotive exhaust system-use excellent in deep drawability which adds one or more of Cu, Ni, W, and Sn. The steels shown in the examples of PLT 5 require that expensive Mo be added to 0.5% or more. As an effect of Sn, this is described as an element which improves the corrosion resistance in the same way as Cu, Ni, and W.

PLT 6 and PLT 7 disclose ferritic stainless steels excellent in surface properties and corrosion resistance which include Mg and Ca as trace elements and methods of production of the same. Sn is an optionally added element. It is described as an element preferable for corrosion resistance.

The steels shown in the examples of PLT 6 and PLT 7 have Sn and expensive Co added to them together. These steels are 11.6% Cr steel or 16% Cr steel containing large amounts of C or another impurity element. The pitting potential is described as being respectively 0.086 and 0.12V. This pitting potential does not in the end reach the corrosion resistance corresponding to SUS304 targeted by the present invention.

PLT 8 discloses ferritic stainless steel excellent in crevice corrosion resistance having Sn and Sb as trace elements for the purpose of improvement of the pitting life of auto parts etc. The steels shown in the examples of PLT 8 almost all have Sn and Ni added together for improving the pitting resistance at the crevice parts. 16% Cr steel to which Sn is added alone is high in amount of Si and does not correspond to the high purity ferritic stainless steel covered by the present invention.

CITATION LIST

Patent Literature

PLT 1: Japanese Patent Publication (A) No. 2008-1945
PLT 2: Japanese Patent Publication (A) No. 6-172935
PLT 3: Japanese Patent Publication (A) No. 7-34205
PLT 4: Japanese Patent Publication (A) No. 2000-169943
PLT 5: Japanese Patent Publication (A) No. 2001-262234
PLT 6: Japanese Patent Publication (A) No. 2001-288543
PLT 7: Japanese Patent Publication (A) No. 2001-288544
PLT 8: WO2007/129703

SUMMARY OF INVENTION

Technical Problem

As explained above, in the past, the technique for improvement of the corrosion resistance utilizing trace elements has been to add P alone or add Sn or Sb with expensive rare elements of Co or Ni and No together. There are problems from the viewpoints of manufacturability, formability, and cost of materials. On the other hand, high purity ferritic stainless steel excellent from the viewpoints of formability and cost was relatively inferior in corrosion resistance. For this reason, there is a high demand for improvement of the corrosion resistance in high purity ferritic stainless steel to enable use as a stainless steel material provided with manufacturability, formability, low material cost, and corrosion resistance.

Therefore, an object of the present invention is to provide an alloy-saving type of high purity ferritic stainless steel not dependent on the addition of rare elements which is improved in corrosion resistance to an extent no different from SUS304 or higher.

Solution to Problem

The inventors engaged in intensive research on the relationship between coating modification and corrosion resistance of the steel surface due to addition of Sn in high purity ferritic stainless steel so as to solve the above problems, obtained the following new discovery, and thereby completed the present invention.

(a) By modifying the coating so as to satisfy both the formula (1) and the formula (2) in high purity ferritic stainless steel, the pitting potential V'c100 is improved. FIG. 1 shows the results of measurement of V'c100. The inventors discovered the new finding that by satisfying formula (1) and satisfying formula (2), Sn concentrates in the coating and a value of V'c100 over 0.2V or no different from SUS304 is obtained. From FIG. 1, it is learned that if the value of I(O)/I(Sn) is small, V'c100 becomes larger and the corrosion resistance is improved, so the value of I(O)/I(Sn) is preferably small.

Note that, for the tested steel, 0.8 mm thick high purity ferritic stainless steel sheet containing Cr: 12 to 17%, having Ti: 0.1 to 0.3% and Sn: 0.1 to 0.5% added, and having other ingredients in the range prescribed by SUS430LX was used. The "AP" in FIG. 1 shows the measurement of the V'c after annealing by 850 to 1000° C. ordinary annealing, then dipping in a 50° C.-10% nitric acid-0.3% fluoric acid aqueous solution for 10 seconds for pickling. The "BA" in FIG. 1 shows the measurement of the V'c after bright annealing (850 to 1000° C., 80% $H_2$-20% $N_2$ gas, dew point −60 to −10° C.)

$$0<I(Fe)/I(Cr)<5 \quad \text{formula (1)}$$

$$0<I(O)/I(Sn)<3 \quad \text{formula (2)}$$

(b) For the above coating modification, reducing the C, N, Si, Mn, P, S, and other impurity elements and adding Cr in 13% or more and Sn in 0.001% or more are effective.

(c) In addition to the above ingredients, to selectively concentrate Cr and Sn in the coating, the method of annealing the steel material by final annealing, then pickling it in an aqueous solution containing nitric acid and the method of using bright annealing for final annealing are effective.

(d) The corrosion resistance of stainless steel is often evaluated on a simple basis by the salt spray test defined in the JIS Z 2371. However, if envisioning environments of use inside and outside, the procedure is not the simple one of continuing to spray the salt water. This is accompanied by a cycle of spraying salt water, drying, and humidification. This time, the corrosion resistance is evaluated not by the salt spray test, but by a cycle test simulating conditions closer to the actual environment. Specifically, the tested steel was subjected to a cycle of spraying artificial seawater (35° C., 4 hours), drying (60° C., 2 hours), then exposure to a humid (50° C., relative humidity 95%) atmosphere for 12 cycles, then was evaluated for degree of corrosioning.

(e) Using the test method of the above (d), the corrosion resistance was evaluated using test steels the same as used for measurement of the pitting potential of the above (a). The results are shown in Table 1. For the tests, 0.8 mm thick high purity ferritic stainless steel sheets and those steel sheets deep drawn into cylinders were used. The cylindrical deep drawing conditions are explained later. The degree of corrosioning was evaluated visually. In the table, "very good" indicates a corrosion resistance better than SUS304, "good" indicates a corrosion resistance on a par with SUS304, and "poor" indicates a corrosion resistance inferior to SUS304.

The steels X, Y, and Z satisfying both the formula (1) and the formula (2) explained in the above (a) have a V'c100 higher than the comparative SUS304. On the other hand, the steels U and V not satisfying either the formula (1) or the formula (2) has a V'c100 of less than 0.2V. The corrosion resistances of the steels X, Y, and Z are of extents no different from SUS304 both in the steel sheets and after forming. In particular, the steel X of a high V'c100 exhibited a corrosion resistance better than SUS304.

TABLE 1

| Steel | X | Y | Z | U | V | SUS430LX | SUS304 |
|---|---|---|---|---|---|---|---|
| I (Fe)/ I (Cr) | 1 | 4 | 0.5 | 5.5 | 0.5 | 4.5 | 4 |
| I (O)/ I (Sn) | 0.1 | 0.23 | 1.1 | 0.13 | 3.3 | — | — |
| Vc' 100 | 0.46 | 0.37 | 0.42 | 0.16 | 0.18 | 0.16 | 0.28 |
| Corrosion resistance (material) | Very good | Good | Good | Poor | Poor | Poor | Good |
| Corrosion resistance (worked) | Very good | Good | Good | Poor | Poor | Poor | Good |

(f) As explained above, when satisfying both the above formula (1) and formula (2), the pitting potential V'c100 becomes higher and an effect of improvement of the corrosion resistance is expressed along with this. Such an effective of improvement of the corrosion resistance is believed to be based on the formation of a copresent Sn and Cr coating. This effect continued at least after forming. The reasons are not necessarily clear, but based on the results of analysis by an X-ray photoelectron spectrometer (XPS), it is conjectured to be due to the concentration of Sn in the coating and directly under it.

(g) Further, it is known that Cu, Ni, and Mo have the effect of increasing the corrosion resistance more by composite addition with Sn.

(h) For improvement of the corrosion resistance by the addition of Sn, final annealing the steel material, then holding at a temperature range of 200 to 700° C. is also an effective means. Further, to obtain this effect by bright annealing, it is preferable to make the dew point of the atmospheric gas a range of −20° C. to −50° C.

The gist of the present invention, made based on the findings of the above (a) to (h), is as follows:

(1) A high purity ferritic stainless steel excellent in corrosion resistance comprised of, by mass %, C: 0.001 to 0.02%,
Si: 0.01 to 0.6%,
Mn: 0.01 to 0.6%,
P: 0.005 to 0.04%,
S: 0.0001 to 0.01%,
Cr: 13 to 22%,
N: 0.001 to 0.02%,
Al: 0.005 to 0.05%,
Sn: 0.001 to 1%, and a balance of Fe and unavoidable impurities, the steel characterized by satisfying the two relations of the following formula (1) and formula (2) where I(Fe), I(Cr), I(Sn), and I(O) are the X-ray intensities of the Fe oxides, Cr oxides, Sn oxides, and other detected oxides at the steel surface measured by an X-ray photoelectron spectrometer:

$$0<I(Fe)/I(Cr)<5 \quad \text{formula (1) and}$$

$$0<I(O)/I(Sn)<3 \quad \text{formula (2)}$$

(2) A high purity ferritic stainless steel excellent in corrosion resistance as set forth in (1), characterized in that the steel further contains, by mass %, one or more of:

Ti: 0.05 to 0.35%,
Ni: 0.05 to 0.5%,
Cu: 0.05 to 0.5%,
Nb: 0.05 to 0.7%,
Mo: 0.005 to 0.5%,
Mg: 0.0001 to 0.005%,
B: 0.0003 to 0.005%, and
Ca: 0.0003 to 0.005%.

(3) A high purity ferritic stainless steel excellent in corrosion resistance as set forth in (1) or (2), characterized in that, at the steel surface, a pitting potential V'c100 in a 30° C., 3.5% NaCl aqueous solution is over 0.2V (V v.s. AGCL).

(4) A method of production of a high purity ferritic stainless steel excellent in corrosion resistance comprising hot forging or hot rolling high purity ferritic stainless steel as set forth in any one of (1) to (3) to obtain a hot rolled steel material and repeatedly cold working and annealing it, the method of production of the steel material characterized by annealing at a temperature higher than 800° C. for final annealing, then cooling this by a cooling rate of 10° C./sec or more down to 700° C. or less, holding this in a 200 to 700° C. temperature range for at least 1 minute for cooling, then pickling in an aqueous solution containing, by wt %, at least 5% nitric acid.

(5) A method of production of a high purity ferritic stainless steel excellent in corrosion resistance comprising hot forging or hot rolling high purity ferritic stainless steel as set forth in any one of (1) to (3) to obtain a hot rolled steel material and repeatedly cold working and annealing it, the method of production of the steel material characterized by making an atmospheric gas at least 50 vol % of hydrogen gas and a' balance of substantially nitrogen gas, making a dew point of the atmospheric gas −50° C. to −20° C., and performing final annealing at a high temperature of more than 800° C. by bright annealing.

Note that, the oxides at the steel surface can be quantitatively analyzed for state of presence using an X-ray photoelectron spectrometer (XPS). The oxides of Fe, Cr, and Sn can be confirmed by detection of the peaks at the binding energies. As other oxides, Ti, Si, Mn, or other oxides are detected.

Fe oxides (Fe2P electrons): 709 to 714 eV
Cr oxides (Cr2P electrons): 575 to 580 eV
Sn oxides (Sn3d electrons): 485 to 488 eV Further, the pitting potential is measured based on JISG0577 in a 30° C., 3.5% sodium hydroxide aqueous solution in the untreated state of the steel sheet surface. The electrode used was made AgCl. The value of the pitting potential V'c100 was measured. Note that, (V v.s. AGCL) means the method of measurement of the pitting potential based on JISG0577 when the electrode is AgCl.

Advantageous Effects of Invention

According to the present invention, the remarkable effect is exhibited that it is possible to obtain an alloy-saving type of high purity ferritic stainless steel having a corrosion resistance of an extent no different from SUS304 or better without inviting a rise in the cost of materials.

BRIEF DESCRIPTION OF DRAWINGS

FIG. 1 is a graph of the relationship between the coating properties and pitting potential of the steel material surface.

DESCRIPTION OF EMBODIMENTS

Below, the requirements of the present invention will be explained in detail. Note that the indications "%" of the contents of the elements mean "mass %".

(I) The reasons for limitation of the ingredients will be explained below.

C degrades the formability and corrosion resistance, so the smaller the content, the better. For this reason, the upper limit is made 0.02%. However, excess reduction leads to an increase in the refining costs, so preferably the lower limit is made 0.001%. More preferably, considering the corrosion resistance and manufacturing costs, the amount is made 0.002 to 0.005%.

Si is sometimes added as a deoxidizing element. However, it is a solution strengthening element. From suppression of the drop in elongation, the smaller the content, the better, so the upper limit is made 0.6%. However, excessive reduction leads to an increase in the refining costs, so the lower limit is made 0.01%. Preferably, considering the formability and manufacturing costs, the amount is made 0.03 to 0.15%.

Mn, like Si, is a solution strengthening element, so the smaller the content, the better. For suppression of the drop in elongation, the upper limit is made 0.6%. However, excessive reduction leads to an increase in the refining costs, so the lower limit is made 0.01%. Preferably, considering the formability and manufacturing costs, the amount is made 0.03 to 0.15%.

P, like Si and Mn, is a solution strengthening element, so the smaller the content, the better. For suppression of the drop in elongation, the upper limit is made 0.04%. However, excessive reduction leads to an increase in the refining costs, so preferably the lower limit is made 0.005%. More preferably, considering the manufacturing costs and formability, the amount is made 0.01 to 0.02%.

S is an impurity element. It inhibits the hot formability and corrosion resistance, so the smaller the content, the better. For this reason, the upper limit is made 0.01%. However, excessive reduction leads to an increase in the refining costs, so preferably the lower limit is made 0.0001. More preferably, considering the corrosion resistance or manufacturing cost, the amount is made 0.001 to 0.005%.

Cr is an essential element for securing the corrosion resistance. To secure the pitting potential and corrosion resistance of the present invention, the lower limit is made 13%. However, addition of over 22% leads to a rise of the cost of material and a drop in the formability and manufacturability. Accordingly, the upper limit of Cr is made 22%. Preferably, considering the corrosion resistance and formability and the manufacturability, the amount is made 15 to 18%.

N, like C, causes the deterioration of the formability and the corrosion resistance, so the smaller the content, the better, therefore the upper limit is made 0.02%. However, with an excessive drop, there is the concern that the TiN, which forms the nuclei for formation of ferrite grains at the time of solidification, will not precipitate, the solidified structure will become one of columnar crystals, and anti-ridging property of the product will deteriorate. For this reason, the lower limit is made 0.001%. Preferably, considering the corrosion resistance and formability, the amount is made 0.003 to 0.012%.

Al is an element effective as a deoxidizing agent, so the lower limit was made 0.005%. However, excessive addition causes deterioration of the formability or the toughness and weldability, so the upper limit was made 0.05%. Preferably, considering the refining cost, the amount is made 0.01 to 0.03%.

Sn is an essential element for securing the corrosion resistance targeted by the present invention without relying on alloying of Cr and Mo or addition of rare elements like Ni and Co. To raise the pitting potential targeted by the present invention and improve the corrosion resistance, the lower limit was made 0.001%. Preferably, the amount is made at least 0.01%, more preferably at least 0.1%.

However, excessive addition leads to a drop in the formability and manufacturability. The effect of improvement of the corrosion resistance is also saturated. For this reason, the upper limit was made 1%. Preferably, considering the formability and the manufacturability, the upper limit is made 0.8% or less. More preferably, from the balance of the corrosion resistance and formability and the manufacturability, the upper limit is made 0.6%.

Ti fixes the C and N and promotes softening. It is an element extremely effective for improving the elongation and r-value and is added according to need. When added, the amount is made 0.05% or more for obtaining this effect. However, Ti is also a solution strengthening element. Excessive addition leads to a drop in elongation. For this reason, the upper limit is made 0.35%. Preferably, considering formability and manufacturability, the amount is made 0.1 to 0.2%.

Ni, Cu, and No are elements which improve the corrosion resistance due to a synergistic effect with Sn. In the case of addition, the amount is made 0.05% or more for obtaining this effect. However, if over 0.5%, a rise in the cost of materials or a drop in formability is invited, so the upper limit is made 0.5%. Mo is a particularly rare element, so the upper limit in the case of addition is made less than 0.5%. In the case of addition, the preferable range of Ni and Cu is 0.1 to 0.4%, while the preferable range of Mo is 0.1 to 0.3%.

Nb is an element, like Ti, which improves the elongation and r-value and is also effective for improving the corrosion resistance. It is added in accordance with need. If the case of addition, the amount is made 0.05% for obtaining this effect. However, excessive addition causes a rise in the material strength and a drop in elongation, so the upper limit is made 0.7%. Preferably, considering corrosion resistance and formability, it is made 0.2 to 0.4%.

Mg forms Mg oxides with Al in molten steel so as to act as a deoxidizing agent and also acts as nuclei for precipitation of TiN. TiN forms the nuclei for solidification of the ferrite phase in the solidification process. By promoting the precipitation of TiN, it is possible to make the ferrite phase finer at the time of solidification. By making the solidified structure finer, it is possible to prevent ridging or roping of the product or other surface defects arising due to coarse solidified structures. In addition, Mg is added in accordance with need so as to improve the formability. When added, the amount is made 0.0001% or more for obtaining these effects. However, if over 0.005%, the manufacturability deteriorates, so the upper limit is made 0.005%. Preferably, considering the manufacturability, the amount is made 0.0003 to 0.002%.

B is an element for improving the hot formability and secondary formability. Addition to steel containing Ti is effective. Ti steel uses the Ti to fix the C, so the grain boundary strength falls and grain boundary fracture easily occurs at the time of secondary formation. When added, the amount is made 0.0003% or more for obtaining these effects. However, excessive addition causes a drop in elongation, so the upper limit is made 0.005%. Preferably, considering the cost of material and formability, the amount is made 0.0005 to 0.002%.

Ca is an element which improves the hot formability and cleanliness of the steel and is added when necessary. When added, the amount is made 0.0003% for obtaining these effects. However, excessive addition leads to a drop in the manufacturability and a drop in the corrosion resistance due to CaS or other water soluble inclusions, so the upper limit is made 0.005%. Preferably, considering the manufacturability and corrosion resistance, the amount is made 0.0003 to 0.0015%.

(II) The reasons for limitation of the coating of the steel surface will be explained below:

The high purity ferritic stainless steel of the present invention defines the chemical state of the coating for improving the corrosion resistance.

As explained above, the corrosion resistance is remarkably improved by the copresence of Cr and Sn in the coating of the steel surface. To form a coating with copresence of Cr and Sn effective for improvement of the corrosion resistance, both the following formula (1) and formula (2) have to be satisfied:

$$0<I(Fe)/I(Cr)<5 \quad \text{formula (1)}$$

$$0<I(O)/I(Sn)<3 \quad \text{formula (2)}$$

The chemical state of the Cr or Fe, Sn, and other elements at the steel surface referred to in the present invention can be analyzed using the above-mentioned X-ray photoelectron spectrometer (XPS).

For example, in the range of a binding energy of 709 to 714 eV, in the state where the X-ray count is 100 cps or more, there are Fe oxides ($Fe_2O_3$) present. When the X-ray count is less than 100 cps, there is not much difference from the background. In some cases, the result ends up being buried in the background. For this reason, the count over 100 cps is covered. The X-ray intensity I(Fe) of Fe oxides shows the difference between the detected X-ray count and the background of the range of 709 to 714 eV as the peak intensity (cps). The X-ray intensity I(Cr) of Cr oxides, the X-ray intensity I(Sn) of Sn oxides, and the sum of the X-ray intensities I(O) of oxides other than Fe, Cr, and Sn are measured in the same way as I(Fe).

For example, when oxides of Ti, Si, and Mg are detected, I(O)=I(Ti)+I(Si)+I(Mg).

Further, when only oxides of Ti are detected, I(O)=I(Ti).

In formula (1), when I(Fe)/I(Cr)≥5, the concentration of Fe in the coating becomes high, Cr becomes sparse, and obtaining the corrosion resistance targeted by the present invention by the copresence of Sn and Cr becomes difficult. Therefore, it is possible to make I(Fe)/I(Cr)<5 to obtain the corrosion resistance. Preferably, I(Fe)/I(Cr)<4. The lower limit value of formula (1) is not particularly limited. It should be larger than 0, but from the preferable range of the amount of Cr, making it 0.5 or more is more preferable.

In formula (2), when I(O)/I(Sn)≥3, the concentration of Sn in the coating becomes low, and obtaining the corrosion resistance targeted by the present invention by the copresence of Sn and Cr becomes difficult. Therefore, it is possible to make I(O)/I(Sn)<3 to obtain the corrosion resistance. As explained above, the smaller the I(O)/I(Sn), the higher the pitting potential and the more preferable from the viewpoint of the corrosion resistance. Preferably, I(Fe)/I(Cr)<4. The lower limit value of formula (2) is not particularly limited. It should be larger than 0, but from the preferable range of the amount of Sn, making it 0.1 or more is more preferable.

The thickness of the coating changes depending on the method of production (pickling or bright annealing) explained later, so a clear range cannot be defined, but if 20 angstroms or more, the effect of the present invention is exhibited. However, if over 1000 angstroms, coloration occurs, so the hue of the surface is liable to be impaired. Therefore, the coating thickness is made 1000 angstroms or less. Considering the corrosion resistance and manufacturability, the coating thickness is preferably made 30 to 100 angstroms.

(III) The reasons for limitation relating to the method of production will be explained below.

First, the case of the method of performing the final annealing by ordinary annealing by heating in a combustion atmosphere where natural gas, heavy oil, etc. is burned will be explained.

The final annealing temperature is made over 700° C. to cause the steel to recrystallize after cold working and secure the formability. However, in the high purity ferritic stainless steel which is covered by the present invention, precipitates including Ti and P easily form near 700 to 800° C. To avoid the temperature range of formation of precipitates liable to lead to a drop in the corrosion resistance, the lower limit of the annealing temperature is preferably made 800° C. An excessive rise in the annealing temperature causes the coarsening of the crystal grain size and leads to a skin roughness due to working or the decline in other facets of surface quality. Preferably, the upper limit of the annealing temperature should be made 950° C.

After final annealing, the steel is rapidly cooled by a cooling rate of 700° C. to 10° C./sec. The cooling rate is adjusted to make the residence time in the 200 to 700° C. temperature range at least 1 minute. If over 700° C., as explained above, precipitates containing Ti or P form and lead to a drop in corrosion resistance, so the upper limit is made 700° C. If less than 200° C., the diffusion coefficient of elements in the steel is small and the effect of improvement of the corrosion resistance due to the phenomenon of movement of Sn to the grain boundaries thermodynamically cannot be expected. Therefore, the lower limit is made 200° C. More preferably, the range is made 300 to 600° C.

The residence time from 200 to 700° C. is preferably made 1 minute or more to obtain the effect of improvement of the corrosion resistance due to the concentration of Sn at the coating and directly under it. The upper limit is not particularly defined, but if using an industrial-scale continuous annealing facility, not more than 5 minutes is preferable. More preferably, the time is made not more than 3 minutes.

To modify the coating by the copresence of Sn and Cr targeted by the present invention, the final annealed steel material is pickled in an aqueous solution containing 5 mass % or more of nitric acid. The upper limit of the nitric acid concentration is not particularly limited, but considering the pickling characteristic and cost, it is made 20% or less.

The pickling temperature affects the surface reactions, but with a pickling temperature of ordinary stainless steel (for example 50° C.) or so, there is no problem. For the modification of the coating targeted by the present invention, 45° C. or more is preferable. More preferably, the temperature is made 50 to 70° C. in range. The upper limit of the temperature, from the viewpoint of manufacturing safety, should be made less than 80° C., preferably 70° C.

Note that, the atmosphere of the final annealing at the time of joint use of pickling is not particularly limited.

When making the final annealing bright annealing, the atmospheric gas is comprised of at least 50 vol % of hydrogen gas and a balance of nitrogen gas and unavoidable impurities mixed in. The dew point of the atmospheric gas is made −50° C. to −20° C. Hydrogen gas has an action of reducing the Fe-based oxides at the time of bright annealing, so is preferably made 70% or more. The balance may be made an inert gas not contributing to the oxidation of steel, for example, argon gas etc., but if considering the industrial scale costs, nitrogen gas is preferable. If the hydrogen gas is less than 50 vol %, maintaining and controlling the bright state of the stainless steel surface becomes industrially difficult.

The dew point of the atmospheric gas is made −20° C. or less so as to prevent coloration, reduce Fe oxides, and form Cr oxides ($Cr_2O_3$). To sufficiently suppress the Fe oxides, the dew point is preferably made −30° C. or less. On the other hand, if −50° C. or less, the Sn at the steel surface ends up being reduced and concentration of Sn in the coating is inhibited. For this reason, formation of a coating of copresent Sn and Cr targeted by the present invention is difficult. Therefore, the dew point is made −50° C. or more. From the above, for formation of the coating targeted by the present invention, preferably the dew point of the atmospheric gas is made −30° C. to −50° C. in range.

If making the final annealing bright annealing, the annealing temperature is made one according to the annealing conditions based on ordinary atmospheric heating. However, residence at a 200 to 700° C. temperature range and pickling after annealing, required in atmospheric heating type annealing, need not be performed.

EXAMPLES

Below, examples of the case where the present invention is steel sheet will be explained.

Ferritic stainless steel having the ingredients of Table 2 was smelted, heated to 1150 to 1200° C., and hot rolled to obtain hot rolled steel sheet of a thickness of 3.8 mm. The hot rolled steel sheet was annealed, pickled, then cold rolled to a thickness of 0.8 mm, then final annealed at the temperature described in Table 3. After annealing, it was cooled down to 200° C. by an average cooling rate of 10 to 20° C./sec. After this, the sheet was used for analysis of the coating and evaluation of the corrosion resistance. For the comparative steel, SUS304 (18% Cr-8% Ni) was used.

For analysis of the coating, XPS was used to find the values of I(Fe)/I(Cr) and I(O)/I(Sn). The corrosion resistance was evaluated by measurement of the pitting potential and a cycle test. The pitting potential was measured by the above-mentioned method based on JIS G 0577. The cycle test was performed by the above-mentioned repeated drying and humidification method. For analysis of the coating, a final annealed steel sheet was used. For evaluation of the corrosion resistance, in addition to a final annealed steel sheet (material), a worked product obtained by deep drawing the material into a cylinder was used. The cylindrical deep drawing was performed by a blank size of ϕ80 mm, a punch size of ϕ40 mm, a die size of ϕ42 mm, and a blank holding pressure of 1 ton. For lubrication, a film was used. The corrosion resistance was evaluated by the appearance after a cycle test of 12 cycles. The degree of the corrosioning was evaluated in comparison with SUS304 with the case of it appearing better indicated as "very good", the case of no difference as "good", and the case of inferior as "poor".

Table 3 and FIG. 1 show the test results all together.

From Table 3, Test Nos. 1 to 4, 8, and 11 to 20 are high purity ferritic stainless steels which satisfy the ingredients and coating defined in the present invention. The pitting potential V'c100 is over 0.2V (V v.s. AGCL). A corrosion resistance of an extent no different from SUS304 or above the same is provided.

From FIG. 1 as well, it is learned that if satisfying formula (1) and formula (2) and having a pitting potential V'c100 of over 0.2V (V v.s. AGCL), corrosion resistance is provided.

Here, the corrosion resistance could be confirmed effective not only at the material stage, but even after forming. That is, these steel sheets exhibited the effect of improvement of the corrosion resistance targeted by the present invention. Note that, these steel sheets were produced by the method of production defined by the present invention.

Test Nos. 5 to 7, 9, and 10 had the ingredients defined in the present invention, but were produced by methods other than the method of production of the present invention. These steel sheets failed to satisfy the coating state defined in the present invention, failed to show any improvement in the pitting potential, and failed to provide the corrosion resistance targeted by the present invention.

Test Nos. 21 to 23 were produced by the method of production defined by the present invention, but had ingredients outside those of the present invention. These steel sheets failed to satisfy the coating state defined in the present invention, failed to show any improvement in the pitting potential, and failed to provide the corrosion resistance targeted by the present invention.

TABLE 2

| Steel | C | Si | Mn | P | S | Cr | N | Al | Sn | Ti | Ni | Cu | Nb | Mo | Mg | B | Ca |
|---|---|---|---|---|---|---|---|---|---|---|---|---|---|---|---|---|---|
| A | 0.004 | 0.12 | 0.09 | 0.015 | 0.0016 | 16.2 | 0.009 | 0.012 | 0.55 | 0.17 | — | — | — | — | — | — | — |
| B | 0.004 | 0.12 | 0.1 | 0.014 | 0.001 | 16.2 | 0.01 | 0.013 | 0.21 | 0.18 | — | 0.29 | — | — | — | — | — |
| C | 0.003 | 0.04 | 0.08 | 0.016 | 0.0015 | 16.6 | 0.008 | 0.04 | 0.18 | 0.2 | — | — | — | — | 0.0003 | 0.0009 | — |
| D | 0.01 | 0.5 | 0.2 | 0.035 | 0.0011 | 19.5 | 0.012 | 0.02 | 0.65 | 0.08 | 0.29 | 0.4 | 0.38 | — | — | — | — |
| E | 0.003 | 0.12 | 0.1 | 0.015 | 0.002 | 13.8 | 0.01 | 0.023 | 0.03 | 0.18 | — | — | — | — | — | — | — |
| F | 0.003 | 0.06 | 0.08 | 0.01 | 0.0015 | 16.4 | 0.007 | 0.013 | 0.5 | 0.14 | — | — | — | 0.25 | — | — | — |
| G | 0.009 | 0.11 | 0.07 | 0.012 | 0.0012 | 12.5* | 0.016 | 0.04 | 0.7 | 0.33 | — | — | — | — | 0.0003 | 0.002 | 0.0005 |
| H | 0.003 | 0.04 | 0.1 | 0.01 | 0.0026 | 16.3 | 0.007 | 0.016 | — * | 0.18 | — | — | — | — | 0.0005 | 0.0005 | — |
| I | 0.045* | 0.3 | 0.6 | 0.03 | 0.002 | 16.2 | 0.04* | 0.025 | 0.05 | — | — | — | — | — | — | — | — |
| J | 0.003 | 0.13 | 0.1 | 0.021 | 0.0005 | 13.9 | 0.0064 | 0.04 | 0.1 | — | — | — | — | — | — | — | — |
| K | 0.003 | 0.13 | 0.1 | 0.022 | 0.0004 | 14.1 | 0.008 | 0.05 | 0.11 | — | — | — | 0.1 | — | — | — | — |
| L | 0.003 | 0.13 | 0.1 | 0.022 | 0.0004 | 14.1 | 0.008 | 0.05 | 0.08 | — | — | — | 0.1 | 0.1 | — | — | — |
| M | 0.004 | 0.11 | 0.1 | 0.022 | 0.0006 | 14.2 | 0.011 | 0.048 | 0.12 | 0.006 | — | — | 0.053 | — | — | — | — |
| N | 0.016 | 0.5 | 0.5 | 0.03 | 0.003 | 16.4 | 0.015 | 0.01 | 0.055 | — | — | 0.4 | 0.55 | — | — | — | — |
| O | 0.014 | 0.15 | 0.15 | 0.03 | 0.0045 | 19.4 | 0.015 | 0.005 | 0.009 | — | 0.28 | 0.35 | 0.45 | — | — | 0.0008 | 0.0005 |

TABLE 3

| | No. | Steel | Pitting potential $V^*_{c100}$ (V v.s. AGCL) | Corrosion resistance Material | Corrosion resistance Formed | XPO analysis results of coating I(Fe)/I(Cr) | XPO analysis results of coating I(O)/I(Sn) | Final annealing | AP Resi-dence | AP Nitric acid | BA $H_2$ conc. | BA Dew point | Remarks |
|---|---|---|---|---|---|---|---|---|---|---|---|---|---|
| Invention ingredients | 1 | A | 0.47 | V. good | V. good | 2.0 | 0.1 | 870° C. | Yes | 15% | — | — | Inv. ex. |
| | 2 | | 0.40 | Good | Good | 2.5 | 0.3 | | Yes | 7% | — | — | Inv. ex. |
| | 3 | | 0.33 | Good | Good | 0.5 | 1.5 | | — | — | 60% | −45° C. | Inv. ex. |
| | 4 | | 0.35 | Good | Good | 1.5 | 1.0 | | — | — | 90% | −35° C. | Inv. ex. |
| | 5 | | 0.15* | Poor | Poor | 6.0* | 1.5 | | No* | 3%* | — | — | Comp. ex. |
| | 6 | | 0.12* | Poor | Poor | 1.0 | 4.0* | | — | — | 90% | −60° C.* | Comp. ex. |
| | 7 | | 0.08* | Poor | Poor | 8.0* | 2.0 | | — | — | 90% | −15° C.* | Comp. ex. |
| | 8 | B | 0.42 | V. good | V. good | 2.0 | 0.5 | 920° C. | Yes | 10% | — | — | Inv. ex. |
| | 9 | | 0.16* | Poor | Poor | 6.0* | 2.0 | 870° C. | Yes | 3%* | — | — | Comp. ex. |
| | 10 | | 0.18* | Poor | Poor | 4.0 | 3.5* | 870° C. | No* | 6% | — | — | Comp. ex. |
| | 11 | C | 0.32 | Good | Good | 2.0 | 0.6 | 940° C. | Yes | 8% | — | — | Inv. ex. |
| | 12 | D | 0.65 | V. good | V. good | 1.0 | 0.1 | 980° C. | Yes | 8% | — | — | Inv. ex. |
| | 13 | E | 0.25 | Good | Good | 3.0 | 1.5 | 850° C. | Yes | 12% | — | — | Inv. ex. |
| | 14 | F | 0.50 | V. good | V. good | 2.0 | 0.2 | 870° C. | Yes | 10% | — | — | Inv. ex |
| | 15 | J | 0.21 | Good | Good | 3.0 | 2.0 | 880° C. | Yes | 12% | — | — | Inv. ex |
| | 16 | K | 0.22 | Good | Good | 2.5 | 1.5 | 920° C. | Yes | 12% | — | — | Inv. ex |
| | 17 | L | 0.27 | Good | Good | 2.5 | 1.5 | 900° C. | Yes | 12% | — | — | Inv. ex |
| | 18 | M | 0.25 | Good | Good | 3.0 | 1.5 | 900° C. | Yes | 12% | — | — | Inv. ex |
| | 19 | N | 0.30 | V. good | Good | 2.5 | 2.0 | 970° C. | Yes | 8% | — | — | Inv. ex |
| | 20 | O | 0.40 | V. good | Good | 2.0 | 2.7 | 1000° C. | Yes | 8% | — | — | Inv. ex |
| Comparative ingredients | 21 | G* | 0.15* | Poor | Poor | 5.5* | 3.0* | 830° C. | — | — | 90% | −45° C. | Comp. ex. |
| | 22 | H* | 0.16* | Poor | Poor | 2.5 | I(Sn) = 0* | 860° C. | Yes | 8% | — | — | Comp. ex. |
| | 23 | I* | 0.1* | Poor | Poor | 3.5 | 5.0* | 820° C. | Yes | 8% | — | — | Comp. ex. |
| | SUS304 | | 0.28 | Good | Good | 4.0 | I(Sn) = 0 | 1050° C. | — | 8% | — | — | — |

INDUSTRIAL APPLICABILITY

According to the present invention, it is possible to make use of the excellent formability of high purity ferritic stainless steel while remarkably improving the corrosion resistance and to expand the applications for an alloy-saving type of high purity ferritic stainless steel better in economy compared with austenitic stainless steel.

The invention claimed is:

1. A ferritic stainless steel comprising, by mass %,

C: 0.001 to 0.02%,
Si: 0.01 to 0.6%,
Mn: 0.01 to 0.6%,
P: 0.005 to 0.04%,
S: 0.0001 to 0.01%,
Cr: 13 to 22%,
N: 0.001 to 0.02%,
Al: 0.005 to 0.05%,
Sn: 0.001 to 1%,
Nb: 0.05 to 0.7%,
Ti: 0.05 to 0.35%,
Mo: 0.005 to 0.5%, and
a balance of Fe and unavoidable impurities, said steel characterized by satisfying the two relations of the following formula (1) and formula (2), where I(Fe), I(Cr), I(Sn), and I(O) are the X-ray intensity of the Fe oxides, the X-ray intensity of Cr oxides, the X-ray intensity of Sn oxides, and the sum of X-ray intensities of oxides other than Fe oxides, Cr oxides, and Sn oxides, respectively, at the steel surface measured by an X-ray photoelectron spectrometer:

$$0<I(Fe)/I(Cr)<5 \quad \text{formula (1) and}$$

$$0<I(O)/I(Sn)<3 \quad \text{formula (2).}$$

2. A ferritic stainless steel as set forth in claim 1, characterized in that the steel further contains, by mass %, one or more of:

Ni: 0.05 to 0.5%,
Cu: 0.05 to 0.5%,
Mg: 0.0001 to 0.005%,
B: 0.0003 to 0.005%, and
Ca: 0.0003 to 0.005%.

3. A ferritic stainless steel as set forth in claim 1 or 2, characterized in that, at the steel surface, a pitting potential V'c100 in a 30° C., 3.5% NaCl aqueous solution is over 0.2V.

4. A method of production of a ferritic stainless steel comprising hot forging or hot rolling high purity ferritic stainless steel as set forth in claim 1 or 2 to obtain a hot rolled steel material and repeatedly cold working and annealing it, the method of production of the steel material characterized by annealing at a temperature higher than 800° C. for final annealing, then cooling this by a cooling rate of 10° C./sec or more down to 700° C. or less, holding this in a 200 to 700° C. temperature range for at least 1 to 5 minutes for cooling, then pickling in an aqueous solution containing, by wt %, at least 5% nitric acid.

5. A method of production of a ferritic stainless steel comprising hot forging or hot rolling high purity ferritic stainless steel as set forth in claim 1 or 2 to obtain a hot rolled steel material and repeatedly cold working and annealing it, the method of production of the steel material characterized by performing the final annealing by bright annealing at a higher temperature than 800° C., an atmospheric gas of the same being at least 50 vol % of hydrogen gas and a balance of substantially nitrogen gas and unavoidable impurities, a dew point of the atmospheric gas being −50° C. to −20° C.

6. A method of production of a ferritic stainless steel comprising hot forging or hot rolling high purity ferritic stainless steel as set forth in claim 3 to obtain a hot rolled steel material and repeatedly cold working and annealing it, the method of production of the steel material characterized by annealing at a temperature higher than 800° C. for final annealing, then cooling this by a cooling rate of 10° C./sec or more down to 700° C. or less, holding this in a 200 to 700° C. temperature range for at least 1 to 5 minutes for cooling, then pickling in an aqueous solution containing, by wt %, at least 5% nitric acid.

7. A method of production of a ferritic stainless steel comprising hot forging or hot rolling high purity ferritic stainless steel as set forth in claim 3 to obtain a hot rolled steel material and repeatedly cold working and annealing it, the method of production of the steel material characterized by performing the final annealing by bright annealing at a higher temperature than 800° C., an atmospheric gas of the same being at least 50 vol % of hydrogen gas and a balance of substantially nitrogen gas and unavoidable impurities, a dew point of the atmospheric gas being −50° C. to −20° C.

* * * * *

UNITED STATES PATENT AND TRADEMARK OFFICE

CERTIFICATE OF CORRECTION

PATENT NO. : 8,721,960 B2
APPLICATION NO. : 12/998816
DATED : May 13, 2014
INVENTOR(S) : Masaharu Hatano et al.

It is certified that error appears in the above-identified patent and that said Letters Patent is hereby corrected as shown below:

In the Specification

Column 2, line 64, change "and No together." to -- and Mo together. --;

Column 7, line 32, change "Ni, Cu, and No" to -- Ni, Cu, and Mo --.

Signed and Sealed this
Eleventh Day of November, 2014

Michelle K. Lee

Michelle K. Lee
*Deputy Director of the United States Patent and Trademark Office*